United States Patent [19]

Neese

[11] Patent Number: 5,002,786

[45] Date of Patent: Mar. 26, 1991

[54] METHOD OF KILLING LARVAE IN INFESTED FRUIT

[75] Inventor: Harvey C. Neese, Troy, Id.

[73] Assignee: Idaho Research Foundation, Inc., Moscow, Id.

[21] Appl. No.: 415,403

[22] Filed: Sep. 29, 1989

Related U.S. Application Data

[63] Continuation of Ser. No. 158,615, Feb. 22, 1988, abandoned.

[51] Int. Cl.[5] ..... B65B 5/04; B65B 53/02

[52] U.S. Cl. ..... 426/412; 426/410; 426/419; 426/413

[58] Field of Search ..... 426/419, 410, 412, 413, 426/415, 106

[56] References Cited

U.S. PATENT DOCUMENTS 2,438,089 3/1948 Carson .
2,486,759 11/1949 Pfeiffer .
2,490,781 12/1949 Cloud .
2,597,041 5/1952 Stokes .
3,450,544 6/1969 Badran et al. .
3,630,759 12/1971 Rumberger .
3,851,440 12/1974 Horsky .
4,066,811 1/1978 Naito et al. .
4,423,080 12/1983 Bedrosian et al. .
4,553,373 11/1985 Viitanen et al. ..... 426/410

FOREIGN PATENT DOCUMENTS 1000603 8/1965 United Kingdom ..... 426/410

OTHER PUBLICATIONS

Agriculture Research Service Progress Report 1987, Armstrong et al. (CRIS Database).

Pliofilm in the Presentation of Florida Fruits & Vegetables, U. of Fla., Agricultural Exper. Stn, Stahl et al., 2/42.

*Primary Examiner*—Steven Weinstein

*Attorney, Agent, or Firm*—Richard L. Neeley

[57] ABSTRACT

A method of killing insect larvae in larvae-infected fruit is disclosed, which comprises shrinkwrapping individual fruit from a geographical area infested with an insect known to infect the fruit for a time sufficient to kill larvae of the insect, wherein no treatment of the fruit to kill the insect or the insect larvae occurs between picking and shrinkwrapping the fruit. Shrinkwrapped fruit prepared by the method is also disclosed.

8 Claims, 4 Drawing Sheets

METHOD OF KILLING LARVAE IN INFESTED FRUIT

This is a continuation of application Ser. No. 158,615, filed Feb. 22, 1988, now abandoned.

BACKGROUND OF THE INVENTION

1. Field of the Invention

The present invention is directed to a process for destroying insect eggs and larvae in fruit, particularly larvae in commercial fruit intended for shipping from fruit fly infected areas to non-infected areas.

2. Description of the Background

In addition to the obvious advantages of freshness and availability, modern commercial practices of shipping fruit over great distances have provided a new method by which insect infestation can spread. Insect eggs in infested fruit can hatch in locations far removed from the original infestation, endangering commercial fruit and vegetable growing regions in which natural enemies of the pest are absent or few in number. For example, the appearance of the Mediterranean fruit fly in the California fruit growing regions, probably as a result of this process, has required millions of dollars to be spent to maintain pest control.

Current requirements of the U.S. Department of Agriculture are that fruit from an infested area be subjected to a treatment capable of killing 99.9% of eggs and larvae present in fruit before that fruit can be commercially shipped. Until recently, ethylene dibromide (EDB), used as a fumigant, was the method of choice. Recently, EDB has been banned because of concern over possible carcinogenic effects of residues present in fruits. The current method of choice is a hot water bath, with fruit being submerged for 15–20 minutes in water at a temperature of 150° F. (65° C.). However, there are several disadvantages to the hot water bath technique. The first of these is the time of treatment required, which adds significantly to processing time. Additionally, the extended heat treatment may result in a lessening of fruit quality.

Radiation has been proposed as an alternative. Although this should not affect the quality of the fruit and can be carried out in a short time, questions remain both as to the efficacy and the safety of radiation treatment of foods. Additional questions remain relating to the safety of the operators treating the fruit.

A number of techniques exist for processing foods without regard to insect infestation. For example, packaging of fruit by the commercial grower prior to shipment has now become relatively common, as will be appreciated by anyone who has observed the recent increase in pre-package fruits at grocery stores. For example, apples and oranges are often presented in shallow cardboard trays covered with shrinkwrap material (typically 4 or 6 fruits/package). Grapefruit, pineapple, and papaya have been shipped in the United States as individual shrinkwrapped fruit.

However, shrinkwrapping without additional treatment to kill insect larvae has not been practiced in the United States from fruit fly infested areas because of the USDA regulations referenced above. Fruit from infested areas is typically treated by the hot water treatment described above or by some other treatment to kill insect eggs and larvae.

Accordingly, new techniques are needed for treatment of fruit from fruit fly infested areas that ensure 99.9% egg and larvae kill without requiring extensive treatments that adversely affect the quality of the fruit or require long times to accomplish.

SUMMARY OF THE INVENTION

The present invention provides a method of killing insect eggs and larvae in infested fruit, which comprises shrinkwrapping individual fruit from a geographical area infested with an insect known to infect said fruit for a time sufficient to kill eggs and larvae of said insect, wherein no treatment of said fruit to kill said insect or said insect eggs or larvae occurs between picking and shrinkwrapping said fruit.

BRIEF DESCRIPTION OF THE DRAWINGS

The present invention will be better understood by reference to the following detailed description when considered in combination with the drawings that form part of this specification, wherein.

DESCRIPTION OF SPECIFIC EMBODIMENTS

Figure 1:
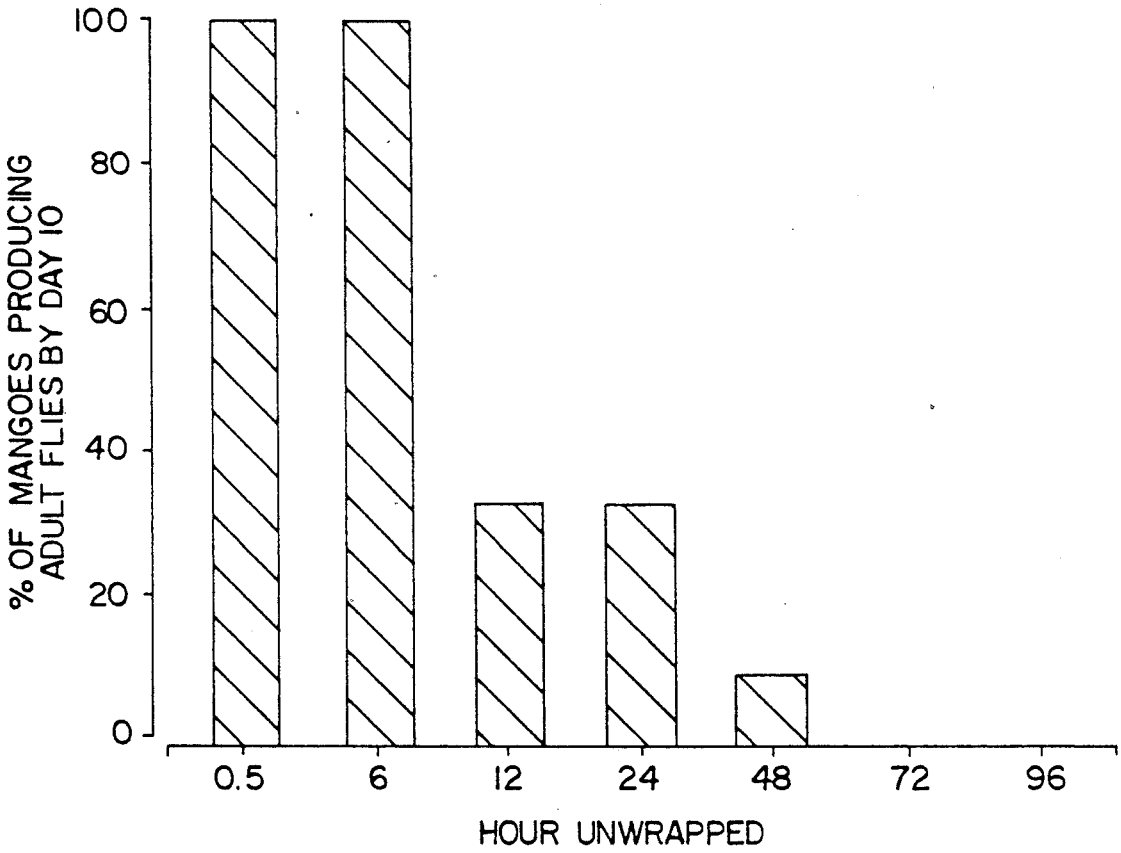
FIG. 1 is a graph showing percent of mangos producing adult flies after infestation and various times wrapping.

The present invention arose during investigations in the laboratory of the inventors in which it was discovered that shrinkwrapping of fruit kills egg and larvae infestations of the fruit. In experiments performed with several insect species, it was observed that larvae already present in fruit when wrapping occurs attempt to escape from the inside of the fruit and lodge between the skin and plastic film. When the fruit remained wrapped for sufficient time, varying slightly between species, all insect eggs and larvae died.

Although shrinkwrapping of individual fruit has previously been carried out in order to increase shelf life and provide for ease of handling, it was not known prior to the present invention that shrinkwrapping alone in the absence of other techniques for killing eggs and larvae would be sufficient to kill eggs and larvae or to meet the strict requirements of the United States Department of Agriculture for killing eggs and larvae in fruit from infested areas. Accordingly, the present invention arises in part from the discovery that a step previously considered to be essential—separate treatment of fruit from infested areas to reduce infestation—is not required if fruit is individually shrinkwrapped.

The mechanism that operates to kill fruit flies is not fully understood. Experiments have indicated that the mild heat used in the shrinkwrapping process (about 350° F., 175° C., for 5 seconds or less) is not sufficient to kill eggs and larvae since fruit treated with this amount of heat alone contain live larvae. Depletion of oxygen is not likely since the plastic film is oxygen permeable, although this has not been scientifically proven. One possible explanation is the build-up of toxic volatile materials, such as ethylene or volatile oil vapors. For example, it is known that citrus oils are toxic to certain insects. However, knowledge of the method of operation is not required for practice of the present invention. Shrinkwrapping of individual fruit and the passage of time will result in the death of insect eggs and larvae while the shrinkwrap will prevent infestation after shrinkwrapping has occurred. Shrinkwraps suitable for use in the food industry are well known. Shrinkwraps used in food are selectively permeable to water vapor and various gases such as oxygen, carbon dioxide and ethylene. Recent improvements in shrinkwrap manufacturing processes provide a wide selection of heat-shrinkable polymeric films with varying properties suited to the specific needs of a particular product. Shrinkwraps such as Cryovac D-955 are typically crosslinked, multi-layered, co-extruded polyolefins. For example, Cryovac D-955 film is a cross-linked, coextruded, multi-layer polyolefin produced using an irradiation process that cross-links the molecular structure of the film. Physical properties of the film include the following: density, 0.922 g/cm$^3$ at 23° C. (ASTM D-1505); tensile strength, 16,000–20,000 psi at 73° F. (ASTM D-882); elongation, 90–120% at 73° F. (ASTM D-882); modulus of elasticity, 50,000–60,000 psi at 73° F. (ASTM D-882): shrink temperature, 250°–300° F. in air; unrestrained shrink, 25% at 220° F., 55% at 240° F., 80% at 260° F. (ASTM D-2732); shrink tension, 350–500 psi at 220° F. (ASTM D-2838); water vapor permeability at 100° F./100% relative humidity, 0.8 gm/ml/24 hrs/100 sq. in. (ASTM F-372): oxygen permeability 5,900 cm$^3$/mil/meter sq./24 hrs/atmosphere at 73° F. (ASTM D-1434); permeability to $CO_2$, 18,000 cm$^3$/mil/meter sq./24 hrs/atmosphere at 73° F.; high permeability to other gases (ASTM D-1434). Shrinkwrap films having similar properties and being approved by appropriate governmental agencies for use in packaging foods are preferred.

The shrinkwrapping process comprises loosely fitting a shrinkwrap material around the fruit, heatsealing any opening, and applying mild heat until the film conforms to the surface of the fruit. Numerous commercial apparatuses are available for carrying out this process. Examples include the L-bar sealer and shrink tunnel. Fruit occupying different volumes is compensated for by the excellent strength and shrink properties of the film.

Over-exposure to high temperature during the shrinking process must be avoided to prevent fruit deterioration.

The method of the invention can be used with any fruit that is subject to infestation by insect eggs and larvae. Particular classes of fruit include citrus and the soft- and smooth-skinned fruits and vegetables. Specific fruit includes papayas, mangoes, oranges, grapefruit, pineapple, apples, pears, and peaches and vegetables such as cucumbers, and bell-peppers. The method of the invention affords protection against infestation by any insect that lives in a larval state in fruit including fruit flies, the melon fly, and the mango weevil. Examples include members of the order Diptera, especially members of the family Teptritidae, and more especially members of the genuses Dacus, Cerattis and Anestrepha.

For the purposes of this invention, killing of larvae is considered sufficient if at least 99%, preferably 99.9%, and more preferably 100% of the larvae are killed after 144 hours, more preferably 96 hours, and most preferably 72 hours or less.

It will be recognized that various limits of ranges, temperatures, times, etc. can be selected independently to provide treatments of various degrees of preference. For example, a series of preferred operating limits of the same level can be selected to provide preferred operating characteristics or the least limiting value can be selected for one variable with more highly preferred values being selected for other variables in order to produce a large number of combinations of operating characteristics of varying degrees of preference while remaining operable.

The invention now being generally described, the same will be better understood by reference to the following detailed examples which are provided for purposes of illustration only and are not to be considered limiting of the invention unless so specified.

EXPERIMENTAL

Example 1

Materials and Methods

The pomace fly, Drosophila melanogaster (Diptera, Drosophilidae), was used as a model. Stock colonies of the fly were maintained on artificial medium. In some experiments, 6–9 first instar larvae were introduced into damaged fruits by transferring them from the artificial medium to the fruit using a probe. Haitian and Mexican mangoes, shipped by a commercial supermarket, were used in the study. The mangoes were shrinkwrapped in Cryovac D 955, a crosslinked polyolefin shrink film (Cryovac Division, W.R. Grace & Co.; Duncan, S.C., 29334). Wrapping and shrinking were accomplished with a model 6300 L-bar magna-lock sealer and model 7001 Weldotron heat tunnel, respectively (Weldotron Corp., Piscataway, N.J., 08854).

Results

The first experiment determined whether adult flies could lay eggs on damaged or undamaged fruit that had been shrinkwrapped. Two test lots of mangoes were used initially. One was green (unripe) and the other was partially yellow, representing the initial stages of ripening. Six different treatments, as indicated in Table 1, were carried out for each of the two lots. Each treatment was replicated twice. Mangoes that were damaged and exposed to adult flies had a circular piece of the peel approximately 2.5 cm in diameter removed. The stage of ripening of the harvested mango was not a determinant of suitability for Drosophila. Adult flies layed eggs on both green and partially yellow damaged unwrapped mangoes, and the resulting larvae developed to adults (Table 1, A). In contrast, mangoes that were treated similarly but which were shrinkwrapped were resistant to infestation. However, adult Drosophila were not able to successfully penetrate the undamaged skin of unwrapped mangoes (Table 1, B).

TABLE 1

The Successful Colonization of Drosophila Larvae in Shrinkwrapped and Unwrapped Mango Fruit

| Group | Treatment of mangoes | Presence of wrap | Insect Infestation G* | Insect Infestation PY* |
|---|---|---|---|---|
| A | Damaged & exposed | – | + | + |
| | to adult flies | + | – | – |
| B | Undamaged & exposed | – | – | – |

TABLE 1-continued

The Successful Colonization of Drosophila Larvae in Shrinkwrapped and Unwrapped Mango Fruit

| Group | Treatment of mangoes | Presence of wrap | Insect Infestation G* | Insect Infestation PY* |
|---|---|---|---|---|
| | to adult flies | + | − | − |
| C | Damaged & infested | − | + | + |
| | with first instar | + | − | − |
| | larvae | | | |

*G = green fruit; PY = partially yellow fruit

To examine the possibility that shrinkwrap could affect the development of larvae already present in mangoes, fruit was damaged by inserting a #1 cork borer, artificially infested with first-instar larvae, and then wrapped immediately afterwards. The wrapped and unwrapped fruits for each treatment were placed in fly-proof cages at room temperature (24°–25° C.) for 10 days. Larvae in unwrapped fruit successfully developed to the adult stage, but those in shrinkwrapped mangoes did not survive (Table 1, C). Within 30 min of wrapping, larvae that were initially feeding inside the fruit were observed to migrate out of the wound and were visible just underneath the wrap. Mangoes that were not wrapped also lost considerably more weight than the wrapped group (Table 1).

The next experiment examined how long the wrap needed to be in place to kill Drosophila larvae. Mangoes were artificially inoculated with larvae as in the previous experiment and were then shrinkwrapped and kept in fly-proof cages at room temperature. The shrinkwraps were removed at 0.5, 6, 12, 24, 48, 72 and 96 hrs after wrapping. Larvae in 4–10 mangoes were examined at each of the above times. As shown in FIG. 1, when the mango was wrapped for 6 hrs or less there was no effect on larval development. However, when it remained in place for 12–48 hrs, it reduced the percentage of mangoes that still harbored viable Drosophila. By 72 hrs, all of the larvae inside the wrap were dead.

When the mangoes were inoculated with fly larvae and then shrinkwrapped, at least 72 hrs were required to kill the larvae. Although the effects of the wrap on larval feeding behavior were immediate, causing insects to exit the fruit within 30 min of wrapping, these larvae were not killed unless the wrap was allowed to remain for a longer period (FIG. 1). Therefore, although conditions were modified within the wrap, these modifications are not lethal to the Drosophila larvae unless the exposure period is at least 72 hours.

Both the Haitian and Mexican mangoes had been treated with EDB before export, and the possibility that residual EDB may have accumulated to lethal concentrations once the fruits were wrapped was considered. To address this concern, a group of domestic peaches, which are not treated with EDB, were infested and wrapped. The same immediate larval migration observed in wrapped mangoes was noted, and 7 days after wrapping, the infestation in the peaches was completely eliminated. Therefore, the result observed with mangoes appeared to be due to the primary or secondary effects of the wrap and not to any residual EDB.

EXAMPLE 2

Figure 2:
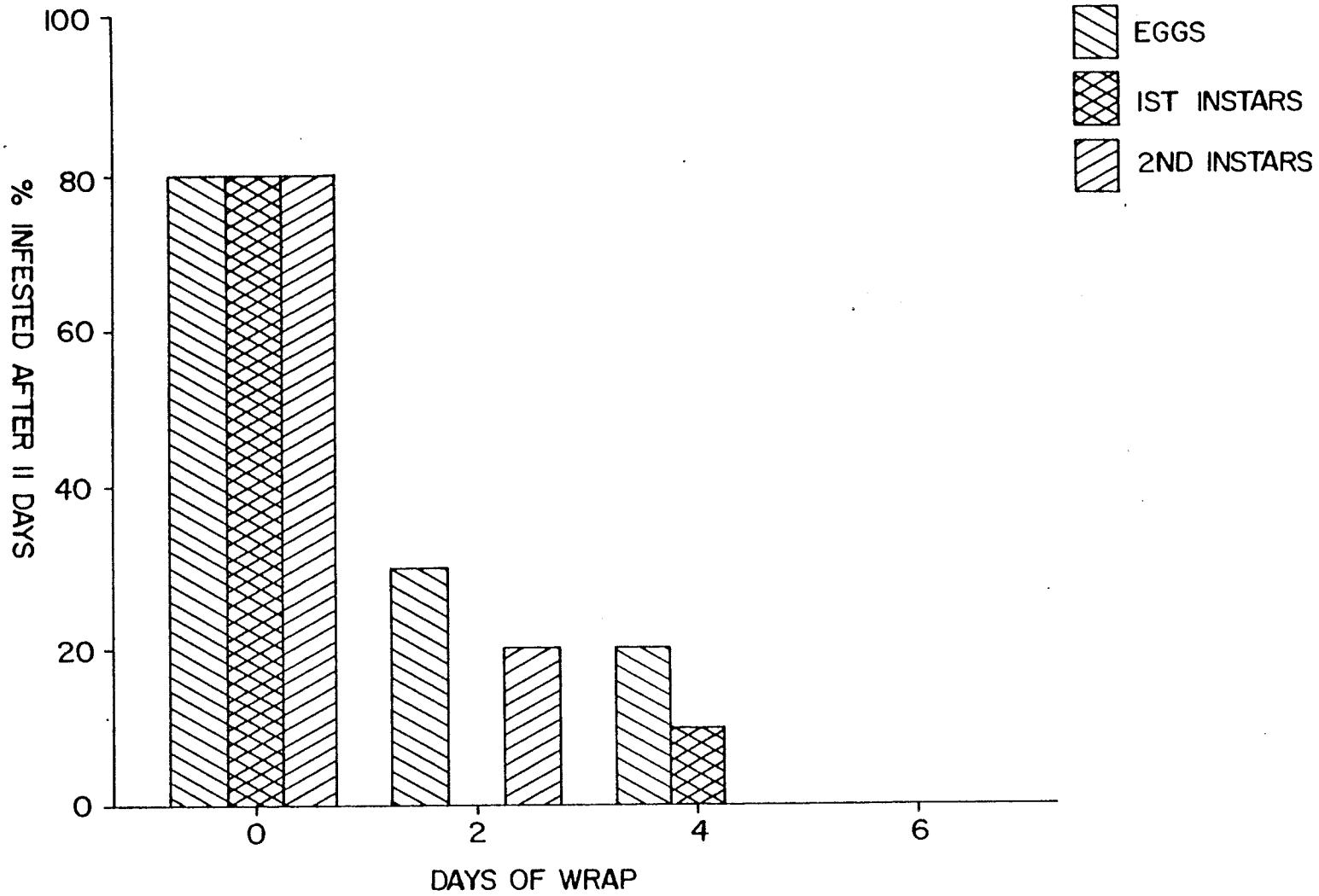
FIG. 2 is a graph showing percent of papayas infested with Oriental fruit flies after infestation and various times of wrapping.

A second series of experiments determined whether shrinkwrapping papayas would protect the fruit against the larvae of the Oriental fruit fly, *Dacus dorsalis*. Adult flies were allowed to lay eggs on the fruits, which were then divided into three groups. One group of papayas was shrinkwrapped immediately afterwards (before eggs hatched), one group was shrinkwrapped 2 days later (first instar larvae present), and a third group was wrapped 4 days later (second instar larvae present). The wrap was allowed to remain for 2, 4, or 6 days in each group before it was removed, and the papayas were examined on day 11 post-infestation for the presence of larvae. As shown in FIG. 2, when the wrap was present for 6 days, no living larvae were detected. Those larvae that were present on the surface of the fruit were dead. Approximately 80% of controls, which were wrapped and immediately unwrapped, contained living larvae.

EXAMPLE 3

Uninfested and disease-free "solo" papayas were obtained from a commerical fresh packer. The papayas were held under ambient (25° C.) conditions until they were half ripe, a stage appropriate for the Oriental fruit fly, *Dacus dorsalis* (*D. dorsalis*) (Hendel) (Diptera, Tephritedae), to oviposit. The fruits were placed for 24 hours inside an infestation cage containing sexually mature *D. dorsalis*. Infested papayas were randomly divided into groups of 10 fruits and the following combinations of wrapping and unwrapping treatments were imposed:

| A. Infested controls<br>Wrapping: Days after infestation* | Unwrapping:<br>Hours after wrapping |
|---|---|
| B. 1 day (eggs) | 1. Immediately (0 hours) |
| | 2. 8 hours |
| C. 3 days (1st instar) | 3. 96 hours |
| | 4. 120 hours |
| D. 5 days (2nd instar) | 5. 144 hours |

* From the time the fruits were placed in the infestation cage.

Three separate trials were conducted. In Trail I, 125 fruits were used, and in Trials II and III 155 fruits each were used and divided as follows: 5 fruits each for treatment combinations B1, C1 and D1, and 10 fruits each for B2, B3, B5, C2,C3, C5, D2, D3, D5, uninfested controls and infested controls. Trial I and II had the additional 30 fruits, divided 10 each for treatment combinations B4, C4, and D4. The papayas were shrinkwrapped in Cryovac D-955. The fruits were bagged individually, sealed on all sides, after which pin-holes were made to allow enclosed air to escape when shrinking. The "bagged" papayas were exposed to hot air for 5 seconds from a heat gun to shrink the film tightly around the papaya. The pin-holes were later covered with scotch tape.

From additional samples, the temperature inside the fruits were recorded prior to shrinking (25° C.) as well as after shrinking the film (26° C.). After and between wrapping treatments the fruits were held at 27° C. on fiber glass trays, which were then placed in a holding cabinet designed by Armstrong et al., 1984. The cabinet doors and sides were fine meshed to prevent any reinfestation. Comparable samples of uninfested papayas were also held in the same cabinets to examine any evidence of natural infestation prior to start of the experiment.

The fruits were scored for infestation 3 days after unwrapping in each of the categories. The controls (nonwrapped) were scored on the day of the first scoring. In the sample unit of 5–10 fruits, the fruits were point scored as follows: 5 points for the fruit with live larvae, 3 points for the fruit with neither live nor dead larvae, and 1 point for the fruit with dead larvae and/or unhatched eggs. The point scoring system was designed to account for all the fruits in a sampling unit because in some cases not all fruits were infested. Mean scores from each sampling unit were analyzed using general linear model procedures for unbalanced data provided by the SAS Institute (P.O. 10066, Raleigh, N.C.).

TABLE 2

Mean Comparisons of Infestation Scores (Least Square Means)

| Mean Treatment | Hours of Unwrapping |
|---|---|
| Controls (unwrapped) - 4.67[a] | 0 hours - 4.82[a] |
| Day 1 unwrapping - 2.97[c] | 48 hours - 4.02[a] |
| (eggs) | 96 hours - 2.27[b] |
| Day 3 unwrapping - 2.88[c] | 120 hours - 2.23b |
| (1st instar larvae) | 144 hours - 1.84c |
| Day 5 unwrapping - 3.27[b] | |
| (2nd instar larvae) | |

Means wih different lower case letters within a column are significantly different ($P < 0.0001$).

Figure 3:
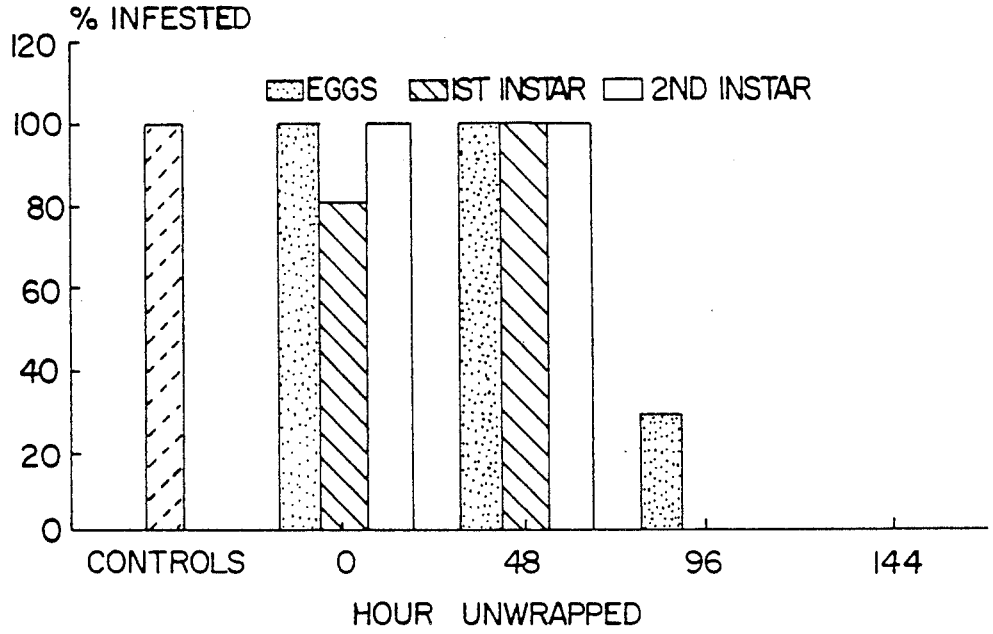
FIG. 3 is a graph showing percent of papayas infested with Oriental fruit flies after infestation and various times of wrapping.
Figure 4:
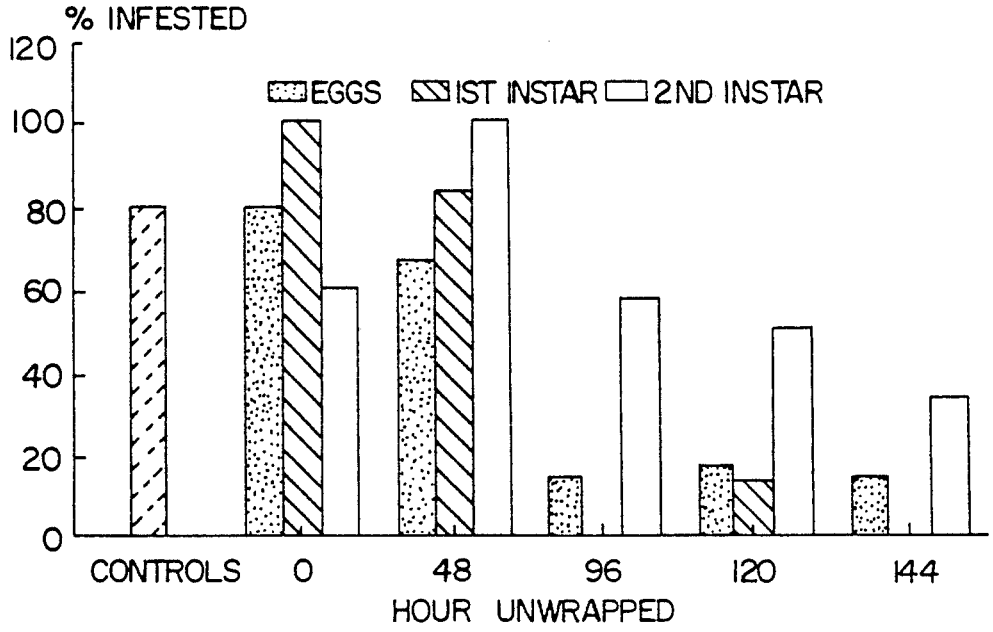
FIG. 4 is a graph showing percent of papayas infested with Oriental fruit flies after infestation and various times of wrapping.
Figure 5:
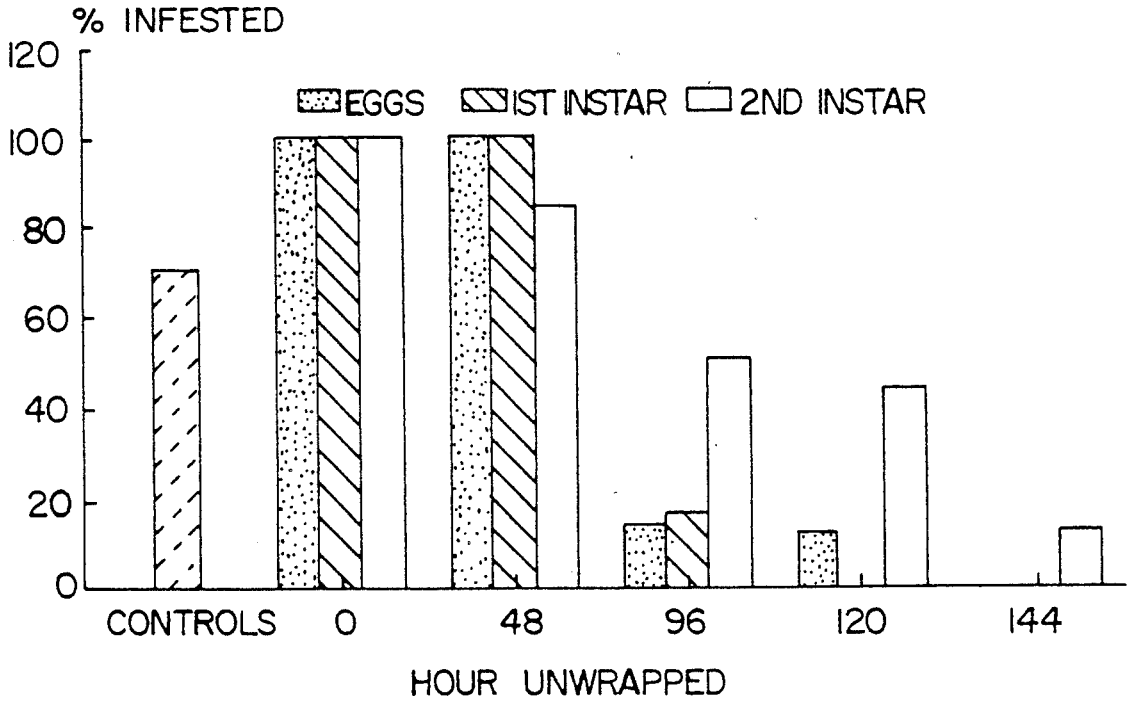
FIG. 5 is a graph showing percent of papayas infested with Oriental fruit flies after infestation and various times of wrapping.

The noninfested controls, in all trials, did not show any infestation, indicating that there was no natural infestation at the start of the experiment. However, the infested controls (nonwrapped) in all 3 trials showed high infestation and significant differences from other treatments (see Table 2, above). These nonwrapped fruits were examined for the larvae development, and in all infested fruits the larvae development continued until pupation. The percent infestation based on the number of fruits infested in each sampling unit is shown in FIGS. 3, 4, and 5, representing Trial I, Trial II, and Trial III, respectively. All three stages of the insect viz., the eggs, the first instar and the second instar larvae showed high percent survival at 0 and 48 hours of unwrapping, but when wraps were held until 96 hours, 120 hours and 144 hours, there were significant decreases in the percent survival of the larvae (see FIGS. 3–5). Zero and 48-hour unwrapping of fruits that were wrapped one day after infestation showed high percent survival, indicating the inability of the wrap to inactivate the eggs in that time frame. However, in fruits unwrapped at 96, 120, and 144 hours, the eggs remained unhatched in most cases (FIGS. 3–5). Similar trends were seen in case of first instar and second instar larvae. Mean comparisons between the least square means of the infestation scores (see Table 2) show highly significant ($p<0.0001$) differences within the main treatment as well as the time elapsed before unwrapping. Table 2 indicates that day 5 unwrapping (2nd instar) was significantly different from the fruits unwrapped at day 1 (eggs) and day 3 (1st instar). This was probably because some fruits in the day 5 group were very highly infested and had deteriorated substantially so that they were unable to be wrapped. This was particularly true in Trials II and III (FIGS. 4 and 5). The small percent survival of the larvae noticed in some fruits at 96, 120 and 144 hours was observed to be due mostly to unnoticeable holes that occurred in the seam of the wrap. This was noted by examining the behaviour of the larvae to move under the seam and feed.

In all cases the effect of the wrap on larvae feeding and movement was immediate, causing the insects to exit the fruit within 30 minutes of wrapping. The larvae remained under the wrap thereafter, and they either revived if the fruits were unwrapped at 48 hours or less or were killed if wrapped for more than 96 hours. Mean comparisons of the infestation scores within the unwrapping treatments show significantly high scores at 0 and 48 hours of unwrapping as compared to significantly low scores when unwrapped after 96 hours (see Table 2).

The study shows that under wrapped conditions the immature stages of the insect have impaired development and unusual movement compared to normal circumstances. In fruits that were unwrapped at 48 hours the larvae appeared stressed and were slow in their development as compared to larvae inside the nonwrapped fruits. The immediate movement of the larvae from the inside to the outside of the fruit suggests that a modified condition forces the migration. Shrinkwrapped fruits have increased levels of $CO_2$ and depleted levels of $O_2$. Higher $CO_2$ levels have toxic effects on the eggs and larvae of other insects such as Cigarette Beetle (*Lasioderma serricorne* F.).

The efficacy of the present procedure can readily be tested using other fruits, shrink films, and related pests, using the techniques described in these examples, as a matter of routine.

These results indicate that individual film wrapping techniques impair development and induce mortality of the immature stages of the fruit fly inside infested fruit when the shrinkwrapping is complete and held for specific periods. This study therefore indicates the potential for shrinkwraps in controlling important pests in a wide variety of tropical fruits and vegetables. Therefore, shrinkwrapping, in addition to its more traditional role in extending shelf life, can replace or supplement existing quarantine methods for fruit fly control.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A method of preventing transmission of an insect pest from a first geographical area in which said pest is located to a second geographical area uninfested by said pest, which comprises:

separately encasing individual fruit from said first geographical area infested by an insect pest known to infest said fruit in a shrink wrap film and heat shrinking said film to produce an encased individual fruit, wherein said first geographical area is subject to a restriction against export of said fruit into areas that are not infested by said insect pest;

maintaining said encased fruit in said shrink wrapped film for a time sufficient to kill at least 99% of eggs and larvae of said insect in said fruit, wherein no treatment of said fruit to kill said insect eggs or larvae occurs between picking and encasing said fruit; and transporting said encased fruit from said infested area to said uninfested area.

2. The method of claim 1, wherein said time is sufficient to kill 99.9% of said larvae.

3. The method of claim 1, wherein said time is at least 96 hours.

4. The method of claim 1, wherein said fruit is papaya.

5. The method of claim 1, wherein said insect is the Oriental fruit fly.

6. The method of claim 1, wherein said fruit is a citrus fruit.

7. The method of claim 1, wherein said fruit is a papaya, mango, orange, grapefruit, pineapple, apple, pear, or peach.

8. The method of claim 1, wherein said fruit is a mango.

* * * * *